US010253529B1

(12) United States Patent
McGinn

(10) Patent No.: US 10,253,529 B1
(45) Date of Patent: Apr. 9, 2019

(54) PORTABLE SAFE WITH TWO-POINT LATCHING MECHANISM

(71) Applicant: Vaultek Safe Inc., Orlando, FL (US)

(72) Inventor: Larry Alan McGinn, Orlando, FL (US)

(73) Assignee: Vaultek Safe Inc., Orlando, FL (US)

( * ) Notice: Subject to any disclaimer, the term of this patent is extended or adjusted under 35 U.S.C. 154(b) by 156 days.

(21) Appl. No.: 15/426,699

(22) Filed: Feb. 7, 2017

Related U.S. Application Data

(60) Provisional application No. 62/422,260, filed on Nov. 15, 2016.

(51) Int. Cl.
*E05B 65/00* (2006.01)
*E05G 1/04* (2006.01)
(Continued)

(52) U.S. Cl.
CPC ..... *E05B 65/0075* (2013.01); *E05B 35/00* (2013.01); *E05B 47/0001* (2013.01);
(Continued)

(58) Field of Classification Search
CPC .... E05B 65/0075; E05B 15/603; E05B 35/00; E05B 47/0001; E05B 49/00; E05B 51/00;
(Continued)

(56) References Cited

U.S. PATENT DOCUMENTS 1,118,435 A * 11/1914 Mosler et al. ..... E05G 1/00 109/59 R
2,819,692 A * 1/1958 Johnson ..... E05G 1/02 109/50

(Continued)

OTHER PUBLICATIONS

"Instruction Manual: VT20i/VT10i," Vaulteksafe.com, downloaded Sep. 27, 2016, all enclosed pages cited.

(Continued)

*Primary Examiner* — Suzanne L Barrett
(74) *Attorney, Agent, or Firm* — Nelson Mullins Riley & Scarborough, LLP

(57) ABSTRACT

A safe comprises a housing having a first housing portion and a second housing defining an interior compartment for storage of items, the second housing portion being pivotal with respect to the first housing portion between closed and open positions. A latching mechanism cooperates with spaced apart first and second strikers to maintain the second housing portion in the closed position. The latching mechanism includes movable first and second locking elements that engage respective of the first and second strikers when the second housing portion is being maintained in the closed position. The first and second locking elements are retracted away from the first and second strikers to release the second housing portion into the open position. A motor having a rotatable output shaft carries a drive dog. A rotating plate rotatable about an axis is also provided, the rotating plate having an engaging element that is driven by the drive dog. First and second levers are pivotally connected at their proximal ends to the rotating plate at substantially diametrically opposed locations, distal ends of the first and second levers being connected to the locking elements.

22 Claims, 6 Drawing Sheets

(51) Int. Cl.

| | |
|---|---|
| ***E05G 1/026*** | (2006.01) |
| ***E05B 51/00*** | (2006.01) |
| ***E05B 49/00*** | (2006.01) |
| ***E05F 15/603*** | (2015.01) |
| ***E05B 47/00*** | (2006.01) |
| ***E05B 35/00*** | (2006.01) |

(52) U.S. Cl.
CPC ..... *E05B 49/00* (2013.01); *E05B 51/00* (2013.01); *E05F 15/603* (2015.01); *E05G 1/026* (2013.01); *E05G 1/04* (2013.01); *E05B 2047/0067* (2013.01); *E05B 2047/0072* (2013.01)

(58) Field of Classification Search
CPC ..... E05B 2047/0067; E05B 2047/0072; E05G 1/026; E05G 1/04
USPC ..... 70/63, 275, 277, 278.1, 278.6, 279.1, 70/280; 109/45, 59 R
See application file for complete search history.

(56) References Cited

U.S. PATENT DOCUMENTS 3,582,169 A * 6/1971 Koenig ..... G11B 23/027 206/405
4,309,065 A 1/1982 Pappas
4,768,021 A * 8/1988 Ferraro ..... E05G 1/005 109/38
5,009,088 A 4/1991 Cislo
5,161,396 A 11/1992 Loeff
5,280,755 A 1/1994 Batur
5,498,040 A 3/1996 Silye
5,595,076 A 1/1997 Weinerman et al.
5,701,770 A 12/1997 Cook et al.
5,760,703 A * 6/1998 Becker ..... E05B 47/0012 235/380
5,826,715 A * 10/1998 Thompson ..... A24F 15/005 206/261
5,881,584 A 3/1999 Brunoski et al.
5,884,948 A 3/1999 Weinerman et al.
5,946,955 A * 9/1999 Suggs ..... E05B 47/068 70/218
5,987,941 A 11/1999 Zocco
6,065,408 A * 5/2000 Tillim ..... E05G 1/005 109/25
6,089,168 A * 7/2000 Dunlap ..... E05C 9/02 109/59 R
6,318,134 B1 11/2001 Mossberg et al.
6,570,501 B2 5/2003 Bushnell et al.
6,766,040 B1 7/2004 Catalano et al.
6,772,612 B2 * 8/2004 Carson ..... E05C 9/043 312/292
6,843,081 B1 1/2005 Painter
6,845,640 B2 1/2005 Loeff et al.
7,040,675 B1 * 5/2006 Ott ..... B60J 7/19 292/123
7,118,483 B2 * 10/2006 Beadell ..... G07F 17/32 463/46
7,178,370 B2 2/2007 Engel
7,546,920 B1 6/2009 Horn et al.
7,878,035 B2 * 2/2011 Yamaguchi ..... B60R 7/06 200/43.11
8,061,514 B2 * 11/2011 Necchi ..... E05B 73/0023 206/1.5
8,074,477 B1 12/2011 Weiche
8,375,752 B2 * 2/2013 Chang ..... E05B 37/0031 70/162
8,746,024 B2 6/2014 Baker
8,903,605 B2 * 12/2014 Bambenek ..... G07C 5/008 16/308
9,218,699 B1 12/2015 McIntyre et al.
9,423,211 B2 8/2016 Ho
9,530,266 B2 * 12/2016 Delattre ..... E05G 1/005
2009/0071208 A1 3/2009 Wang
2009/0151410 A1 * 6/2009 Hapke ..... E05B 47/023 70/208
2011/0203328 A1 8/2011 Vilkomirski et al.
2013/0025511 A1 1/2013 Maxwell
2013/0055933 A1 * 3/2013 Markman ..... E05G 1/005 109/50
2013/0229098 A1 9/2013 Pletcher
2017/0231349 A1 * 8/2017 McLean ..... A47B 81/005 340/5.52

OTHER PUBLICATIONS

Design U.S. Appl. No. 29/579,182, filed Sep. 28, 2016, all enclosed pages cited.

* cited by examiner

PORTABLE SAFE WITH TWO-POINT LATCHING MECHANISM

PRIORITY CLAIM

This application is based upon and claims the benefit of U.S. provisional application Ser. No. 62/422,260, filed Nov. 15, 2016, incorporated herein by reference.

FIELD OF THE INVENTION

The present invention relates to portable safes. More particularly, this invention relates to a portable safe having a novel latching mechanism.

BACKGROUND OF THE INVENTION

In contrast to large safes used in banks or other commercial facilities, small safes are often used by individuals in their homes. These small safes may store valuable items such as jewelry, or important papers. Some small safes are intended to limit access to items such as handguns that can be dangerous when used incorrectly.

Various types of latching mechanisms have been provided for small safes, both manual and motorized. Manual latching mechanisms may utilize a key lock or combination wheel in order to release the latch. Motorized latching mechanisms typically have a motor that releases the latch, which can be actuated by an electronic keypad or biometric sensor. Some latching mechanism designs are more secure than others. For example, some latching mechanisms of the prior art are prone to unintentional opening, such as when the safe is accidentally dropped.

Further room exists in the art for safes having novel latching mechanisms.

SUMMARY OF THE INVENTION

The present invention recognizes and addresses the foregoing considerations, and others, of prior art construction and methods.

One aspect of the present invention provides a safe comprising a housing having a first housing portion and a second housing defining an interior compartment for storage of items, the second housing portion being pivotal with respect to the first housing portion between closed and open positions. A latching mechanism, associated with one of the first housing portion and the second housing portion, cooperates with spaced apart first and second strikers associated with the other of the first housing portion and the second housing portion to maintain the second housing portion in the closed position. For example, the latching mechanism may be associated with the first housing portion.

According to this aspect, the latching mechanism includes movable first and second locking elements that engage respective of the first and second strikers when the second housing portion is being maintained in the closed position. The first and second locking elements are retracted away from the first and second strikers to release the second housing portion into the open position.

The latching mechanism according to this aspect further includes a motor having a rotatable output shaft carrying a drive dog. A rotating plate rotatable about an axis is also provided, the rotating plate having an engaging element that is driven by the drive dog. First and second levers are pivotally connected at their proximal ends to the rotating plate at substantially diametrically opposed locations, distal ends of the first and second levers being connected to the respective locking elements.

In some exemplary embodiments, the rotating plate's axis corresponds to an axis of the output shaft of the motor. Preferably, the drive dog may be located on a flywheel having predetermined mass. The rotating plate may interpose a housing of the motor and the flywheel to form a compact arrangement. The drive dog itself may comprise a radial protrusion on the flywheel, with the engaging element comprising a lateral tab on the rotating plate.

According to some exemplary embodiments, the distal ends of the first and second levers may be pivotally attached to respective first and second stopper plates which are themselves pivotal with respect to a corresponding support structure. For example, the first and second stopper plates may be connected to the first and second locking elements via respective springs. Moreover, the first and second locking elements may also be pivotally connected to the corresponding support structure.

In exemplary embodiments, an electronic controller is provided to control operation of the motor. At least one of a biometric sensor and a combination keypad is preferably in electrical communication with the electronic controller. A mechanical key lock may also be provided, which is operative to engage one of the first and second levers so as to cause the first and second locking elements to be retracted away from the first and second strikers.

According to another aspect, the present invention provides a latching mechanism for maintaining a container cover in a closed position. The latching mechanism comprises spaced apart first and second strikers attached to an inside of the container cover. Movable first and second locking elements engage respective of the first and second strikers when the container cover is being maintained in the closed position. The first and second locking elements are retracted away from the first and second strikers to release the container cover into an open position. A rotatable flywheel carrying a drive dog is also provided. A rotating plate, rotatable about an axis, has an engaging element that is driven by the drive dog. The latching mechanism further includes first and second levers pivotally connected at their proximal ends to the rotating plate at substantially diametrically opposed locations, distal ends of the first and second levers being connected to the respective locking elements.

A still further aspect of the present invention provides a latching mechanism for maintaining a container cover in a closed position. The latching mechanism comprises spaced apart first and second strikers attached to an inside of the container cover. Movable first and second locking elements engage respective of the first and second strikers when the container cover is being maintained in the closed position. The first and second locking elements are retracted away from the first and second strikers to release the container cover into an open position. A motor having a rotatable flywheel on an output shaft thereof is also provided, with the flywheel carrying a drive dog on its periphery. A rotating plate, rotatable about an axis, has an engaging element that is driven by the drive dog. The rotating plate in this embodiment interposes a housing of the motor and the flywheel. The latching mechanism further includes first and second levers pivotally connected at their proximal ends to the rotating plate, distal ends of the first and second levers being connected to the respective locking elements.

The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
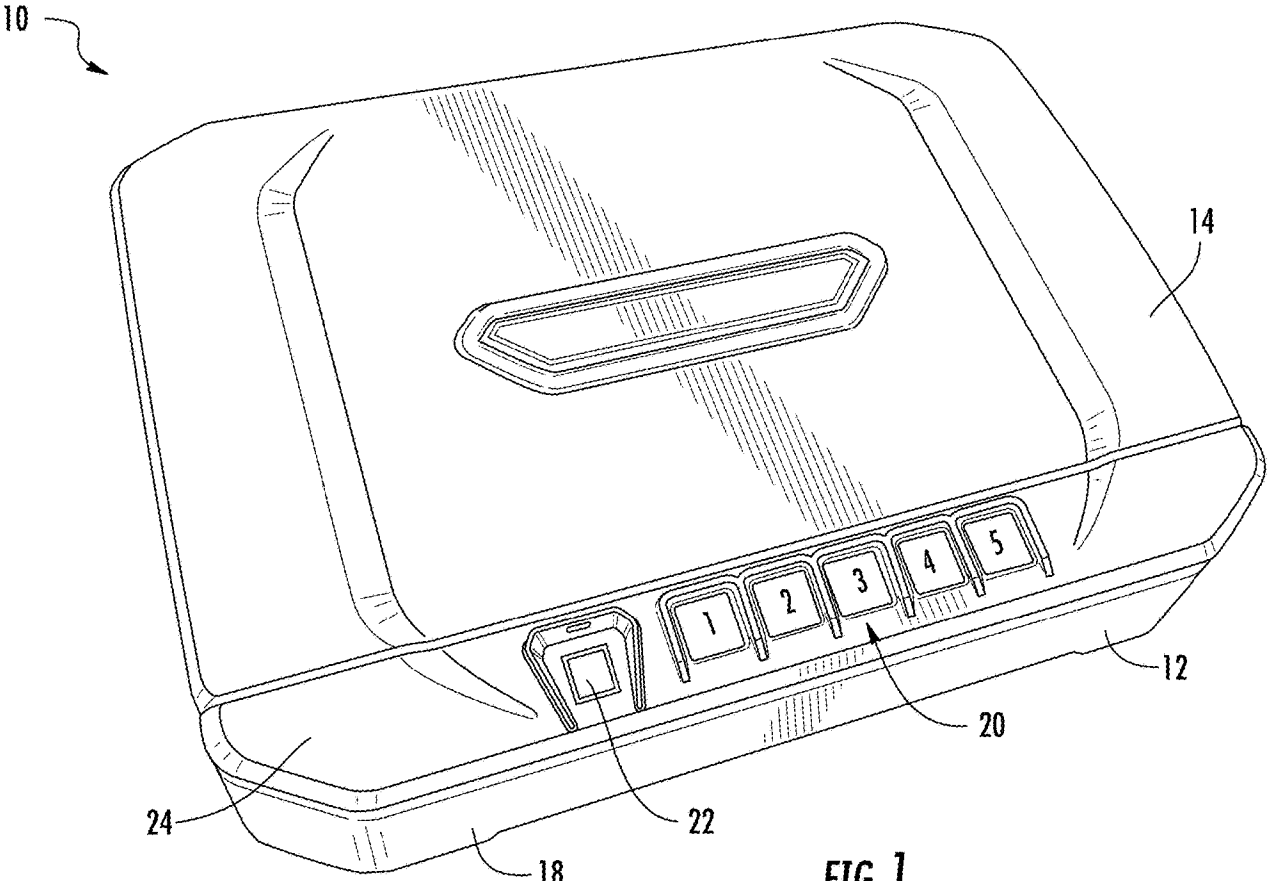
FIG. 1 is a perspective view of a small safe constructed in accordance with an embodiment of the present invention with its cover closed.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
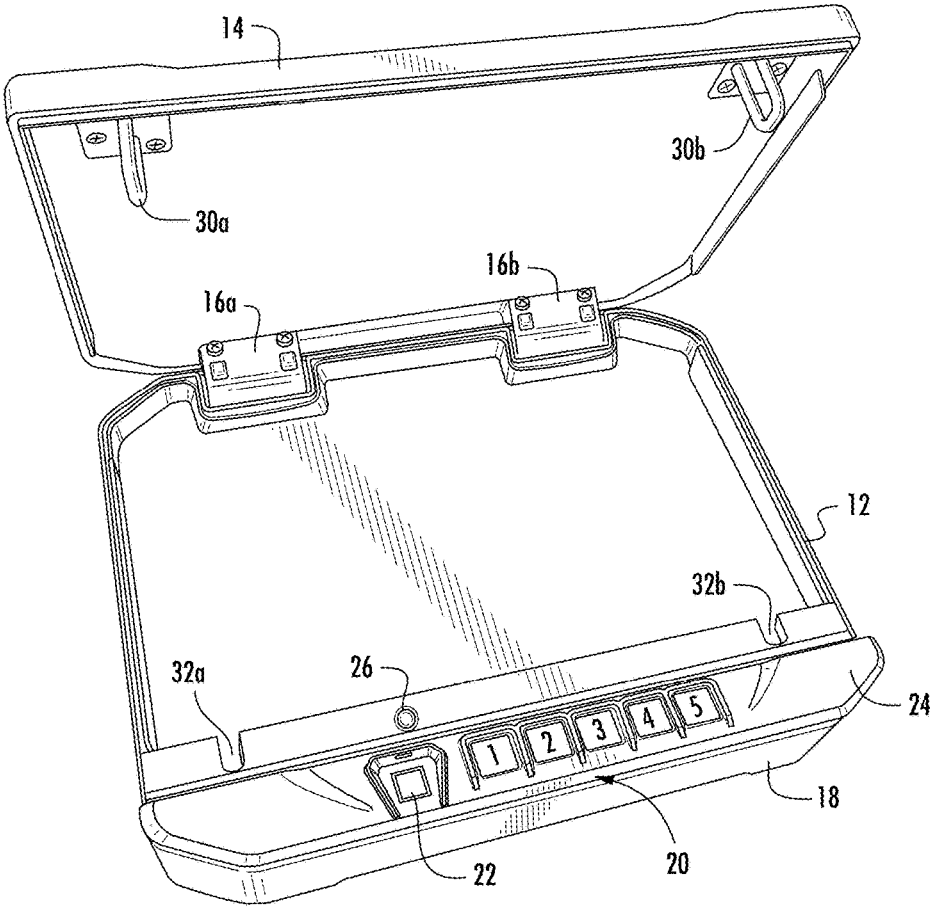
FIG. 2 is a perspective view of the small safe of FIG. 1 with its cover open.

FIGS. 1 and 2 illustrate a safe 10 constructed in accordance with the present invention. Safe 10 preferably has a durable housing formed of steel or another suitable hardened material. As can be seen, the housing has a base 12 to which a cover 14 is pivotally attached at hinges 16*a-b*. Hinges 16*a-b* are preferably located entirely inside the housing so that safe 10 cannot be opened by simply removing the hinges. Preferably, hinges 16*a-b* are spring-loaded such that cover 14 will open fully on its own when the latching mechanism is released. In this embodiment, the bottom of base 12 is substantially flat so as to rest on a bedside table or other flat surface. An anchoring mechanism, such as a suitable tether (not shown), may be provided to connect safe 10 to the structure on which it rests.

As shown in FIG. 2, the interior of the housing defines an interior storage compartment for containing the items to be stored. In this case, the interior compartment is lined with a padding material in order to further protect the stored items. The padding material may slightly compress, particularly when cover 14 is closed, so as to conform to the shape of the stored item(s) and to keep them in place.

Figure 3:
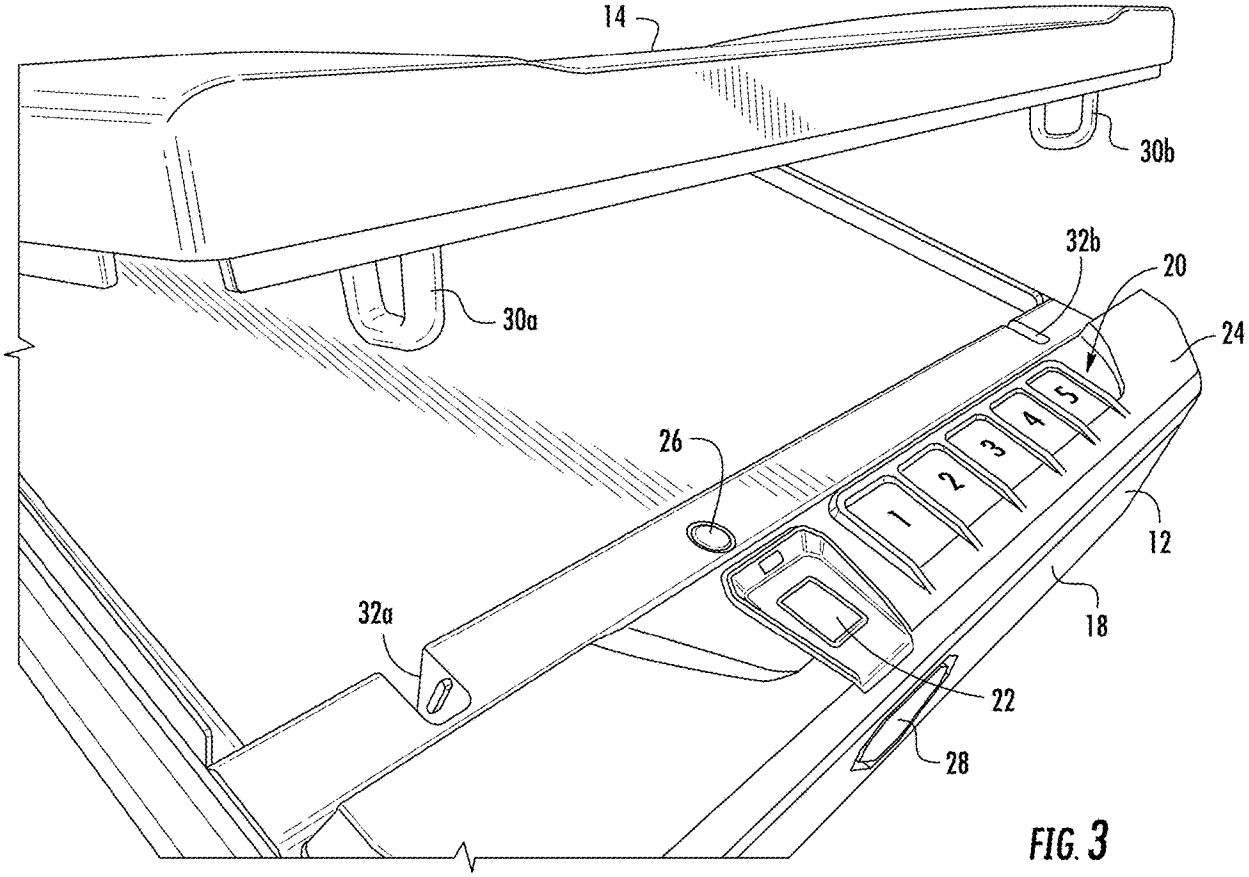
FIG. 3 is a perspective view of the small safe of FIG. 1 with its cover situated between its closed and fully open positions to show clearly the left and right strikers used in the two point latching mechanism.

Referring now also to FIG. 3, base 12 has a front portion 18 defining an enclosure for various electrical and mechanical components of safe 10. These components include mechanical aspects of the latching mechanism by which safe 10 is opened, as well as electronics used for controlling the latching mechanism and other functions. In this embodiment, for example, safe 10 can be opened electrically via a keypad 20 by which a combination is entered or via a biometric sensor 22. As shown, the keypad 20 has a plurality of individual buttons which correspond to different numbers of the combination. When the buttons are depressed in the correct order, the latching mechanism will release. Although five separate buttons are provided in this case, one skilled in the art will appreciate that a lesser or greater number of buttons may be provided as necessary or desired in a particular situation.

Biometric sensor 22 detects known biometric characteristics of the user which, when confirmed, cause the latching mechanism to be released. In this case, biometric sensor 22 is configured as a fingerprint sensor which reads individualized data from the user's fingerprint. As shown, both keypad 20 and biometric sensor 22 are conveniently located on and substantially flush with an upper surface 24 of the housing's front portion 18. A program button 26, accessible only when cover 14 is open, is used to initiate the process by which an authorized user's fingerprint characteristics are stored. Program button 26 also allows a user to select a unique combination for keypad 20 other than the default combination set in the factory.

A mechanical key lock is also provided to release the latching mechanism using a key supplied with safe 10. For example, if there is a complete loss of power causing neither keypad 20 or biometric sensor 22 to be operative, then the key can always be used to open cover 14. In this embodiment, the key hole is located on the front panel of front portion 18, behind a flexible flap 28. Flap 28 protects the key hole, and obscures it from view for aesthetic reasons.

The structure and operation of the latching mechanism inside of front portion 18 will be described in greater detail below. In this regard, however, FIGS. 2 and 3 show the left and right strikers 30*a-b* that are attached to the underside of cover 14. In this case, strikers 30*a-b* are formed as U-shaped hooks that are secured to cover 14, such as by screws, in a manner that is tamperproof from outside safe 10. Strikers 30*a-b* engage the latching mechanism through respective apertures 32*a-b* defined in the front portion 18 of base 12.

Figure 4:
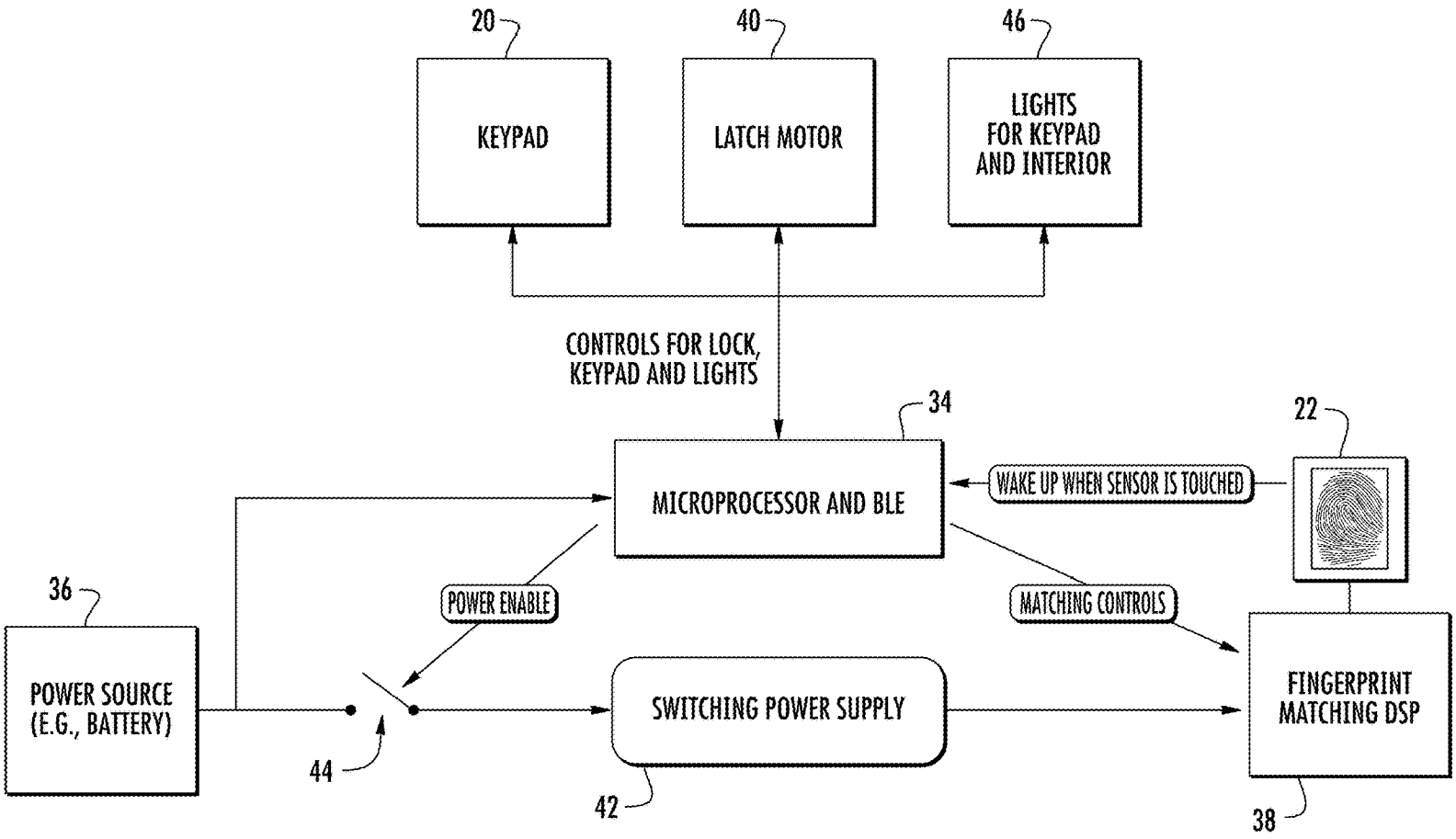
FIG. 4 is a diagrammatic representation showing various components utilized in the small safe of FIG. 1.

Referring now to FIG. 4, additional aspects of safe 10 can be most easily explained. As shown, safe 10 includes a housekeeping controller 34 comprising a microprocessor that controls various electrical and electromechanical functions. In this case, controller 34 further includes a suitable transceiver that allows wireless monitoring and control of safe 10, such as via a smart phone application ("app"). For example, the transceiver may utilize Bluetooth Low Energy ("BLE") technology. Microprocessor 34 and the other electronic components of safe 10 are powered by a power source 36. In exemplary embodiments, power source 36 may comprise one or more suitable rechargeable batteries, such as one or more 4.2V lithium-ion batteries. Energy to recharge the battery may be supplied via any suitable external source, such as using a mini-USB port located on the side of the safe's housing.

Biometric sensor 22 operates in conjunction with a fingerprint matching digital signal processor ("DSP") 38 to determine when a user's fingerprint is recognized. In this regard, controller 34 and DSP 38 communicate when a match is confirmed so that the latching mechanism is released via latch motor 40. Alternatively, controller 34 will cause latch motor 40 to be activated when the correct combination is entered via keypad 20.

DSP 38 and biometric sensor 22 are powered in this case by a switching power supply 42 which converts the voltage of power source 36 to the correct voltage level required by these components. In order to conserve battery power, controller 34 enters into a "sleep mode" during periods of inactivity. Toward this end, a switch 44 (typically an electronic switch) is opened when the sleep mode is in effect to inactivate power supply 42. The sleep mode will cease when biometric sensor 22 or one of the buttons of keypad 20 is touched.

Preferably, touching either biometric sensor 22 or one of the buttons of keypad 20 will be acknowledged by an associated visual indicator. In the case of biometric sensor 22, the visual indicator may be an adjacent LED which is red when the biometric sensor is first touched and turns green when a match is confirmed. The buttons of keypad 20 may be backlighted, such that they are illuminated when one of the buttons is first depressed. In addition, preferred embodiments provide an interior light, such as a bright white LED, which illuminates the interior of the safe's storage compartment when cover 14 is opened. These various lights are collectively indicated at 46 in FIG. 4.

Figure 5:
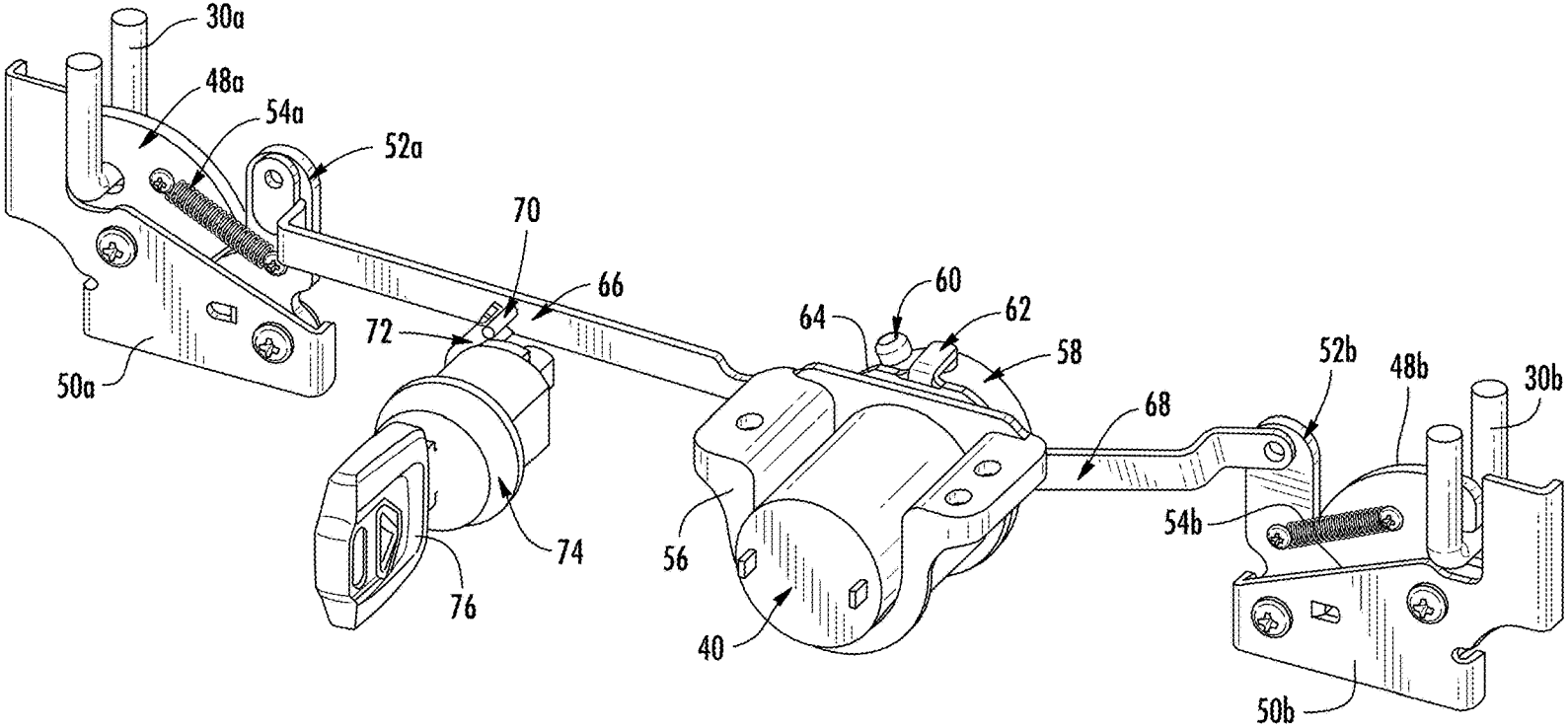
FIG. 5 is a perspective view showing elements of a two point latching mechanism that may be used in the small safe of FIG. 1.

FIG. 5 illustrates an exemplary two-point latching mechanism that may be located in front portion 18 of base 12. As shown, strikers 30*a-b* are engaged by respective lock plates 48*a-b* to secure safe 10 in the closed position. Each of lock plates 48*a-b* are pivotally attached to a respective stationary support structure 50*a* or 50*b*. A respective stopper plate 52*a* or 52*b* is also pivotally attached to one of the support structures 50*a-b*. Stopper plates 52*a-b* are each connected to the associated one of lock plates 48*a-b* via a respective interconnect element. In this embodiment, each of the interconnect elements comprises a respective spring 54*a-b*.

Latch motor 40 is secured to the housing of safe 10, such as via a suitable bracket 56. In this embodiment, a flywheel 58 is attached to the output shaft of motor 40 for rotation therewith. Flywheel 58 has a drive dog 60 that engages a lateral tab 62 on a rotating plate 64. In this case, drive dog 60 is configured as a protrusion on the periphery of flywheel 58. For example, the protrusion may be easily formed by a screw that is threaded into a radial hole defined in flywheel 58. Rotating plate 64 is coaxial with the output shaft of motor 40 but is not directly connected to the output shaft. Instead, rotating plate 64, which is in this case positioned so as to interpose the motor housing and flywheel 58, turns when drive dog 60 is engaged by tab 62. Alternatively, an arcuate slot may be formed in the rotating plate in which a drive dog travels between limits.

The proximal ends of a first drive lever 66 and a second drive lever 68 are pivotally connected to rotating plate 64. As can be most easily seen in FIG. 6A, the connection points for drive levers 66 and 68 on rotating plate 64 are approximately diametrically opposite from each other. The distal ends of drive levers 66 and 68 are pivotally connected to stopper plates 52*a-b*, respectively. It will thus be appreciated that drive levers 66 and 68 serve as linkages between rotating plate 64 and stopper plates 52*a-b*.

In stating that the connection points for drive levers 66 and 68 on rotating plate 64 are "approximately diametrically opposite," it is meant that an imaginary line passing through these connection points may pass just outside of the motor's output shaft rather than through it. The opposed orientation of the connection points desirably makes the latching mechanism more drop tolerant than it might otherwise be. This is because an impact that tends to push drive lever 66 in an opening direction will push drive lever 68 in a closing direction (and vice versa).

Drive lever 66 carries a protrusion 70 at a predetermined location along its length. Protrusion 70 cooperates with a drive dog 72 of key lock 74 to push drive lever 66 in the direction of motor 40. Key lock 74 is manually operated by a key 76 that is inserted by a user into the key hole. As noted above, the key hole is normally covered in this case by a flap 28 that the user can easily move to expose the key hole when desired.

Figure 6A:
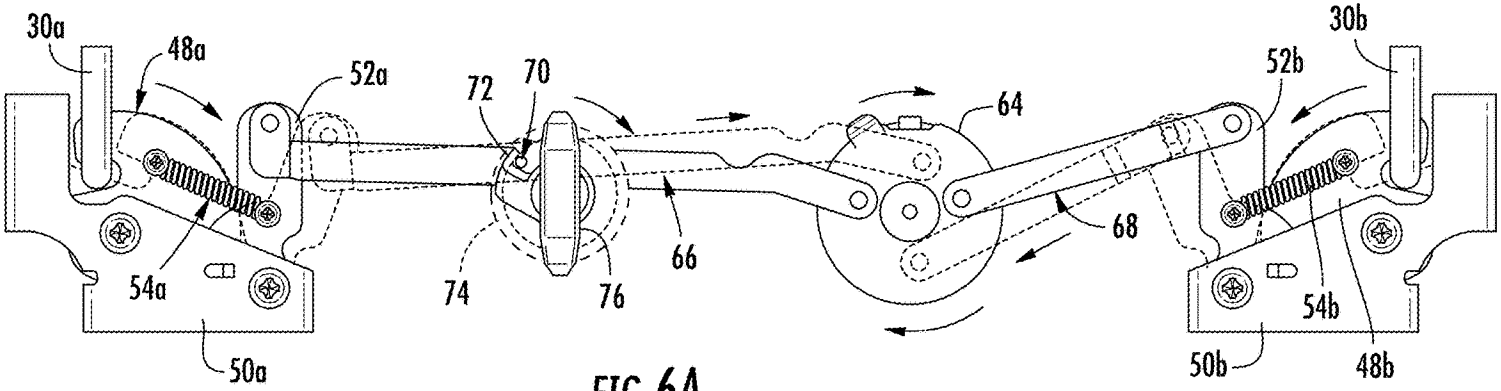
FIGS. 6A and 6B illustrate the two point latching mechanism of FIG. 5 being opened via the key lock and motor, respectively.

Opening of the latch mechanism using key lock 74 can be explained most easily with reference to FIG. 6A. As the key lock 74 is rotated via key 76, drive dog 72 pushes protrusion 70. As a result, drive lever 66 pushes rotating plate 64 to turn in the clockwise direction in this view. As a result, drive lever 68 will be pulled in the direction of drive motor 40. Both of stopper plates 52*a-b* will be pivoted inwardly, thus pulling the associated lock plates 48*a-b* through respective springs 54*a-b*. As a result, strikers 30*a-b* are released and safe 10 is opened.

Figure 6B:
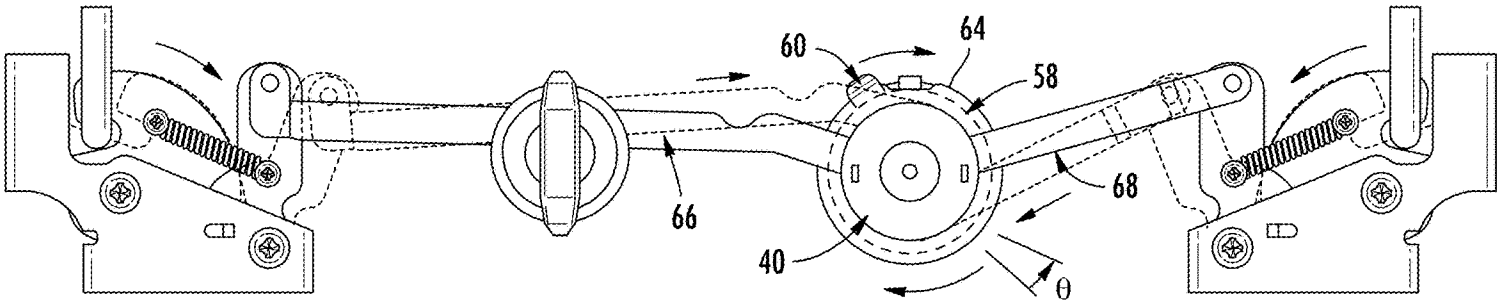

Opening of the latch mechanism using motor 40 can be explained most easily with reference to FIG. 6B. As flywheel 58 is rotated via motor 40, drive dog 60 engages tab 62 to turn rotating plate 64 in the clockwise direction. As a result, drive levers 66 and 68 will both be pulled in the direction of drive motor 40. Both of stopper plates 52*a-b* will be pivoted inwardly, thus pulling the associated lock plates 48*a-b* through respective springs 54*a-b*. As a result, strikers 30*a-b* are released and safe 10 is opened.

Preferably, motor 40 may be a DC stepper motor that may move and stop in discrete increments as directed by controller 34. The mass of flywheel 58 provides inertia that can be used to facilitate opening of the latching mechanism. In the regard, motor 40 preferably rotates flywheel 58 in the direction opposite the opening direction for a predetermined arc, before changing to the opening direction. For example, as illustrated in FIG. 6B, flywheel 58 may be first rotated counterclockwise by an angle θ before being rotated clockwise to open the latching mechanism. As a result, flywheel 58 will have more inertia when drive dog 60 engages tab 62.

It can thus be seen that the present invention provides a small safe utilizing a novel latching mechanism. While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A safe comprising:

a housing having a first housing portion and a second housing defining an interior compartment for storage of items, said second housing portion being pivotal with respect to said first housing portion between closed and open positions;

a latching mechanism associated with one of said first housing portion and said second housing portion, said latching mechanism cooperating with spaced apart first and second strikers associated with another of said first housing portion and said second housing portion to maintain said second housing portion in the closed position;

said latching mechanism including:

movable first and second locking elements that engage respective of said first and second strikers when said second housing portion is being maintained in the closed position, said first and second locking elements being retracted away from said first and second strikers to release said second housing portion into the open position;

a motor having a rotatable output shaft carrying a drive dog;

a rotating plate rotatable about an axis, said rotating plate having an engaging element that is driven by said drive dog, wherein said axis of said rotating plate corresponds to an axis of the output shaft of the motor; and first and second levers pivotally connected at their proximal ends to said rotating plate at substantially diametrically opposed locations, distal ends of said first and second levers being connected to said locking elements.

2. A safe as set forth in claim 1, wherein said drive dog is located on a flywheel having predetermined mass.

3. A safe as set forth in claim 2, wherein said rotating plate interposes a housing of the motor and the flywheel.

4. A safe as set forth in claim 3, wherein said drive dog comprises a radial protrusion on said flywheel and said engaging element comprises a lateral tab on said rotating plate.

5. A safe as set forth in claim 1, wherein said distal ends of said first and second levers are pivotally attached to respective first and second stopper plates which are themselves pivotal with respect to a corresponding support structure.

6. A safe as set forth in claim 5, wherein said first and second stopper plates are connected to said first and second locking elements via respective springs.

7. A safe as set forth in claim 5, wherein said first and second locking elements are pivotally connected to the corresponding support structure.

8. A safe as set forth in claim 1, further comprising an electronic controller operative to control operation of said motor.

9. A safe as set forth in claim 8, further comprising at least one of a biometric sensor and a combination keypad in electrical communication with said electronic controller.

10. A safe as set forth in claim 9, comprising both said biometric sensor and said combination keypad.

11. A safe as set forth in claim 9, further comprising a mechanical key lock operative to engage one of said first and second levers so as to cause said first and second locking elements to be retracted away from said first and second strikers.

12. A safe as set forth in claim 1, wherein said latching mechanism is associated with said first housing portion and said first and second strikers are attached to an inside surface of said second housing portion.

13. A safe as set forth in claim 12, wherein said first and second strikers are each substantially U-shaped.

14. A safe as set forth in claim 1, wherein said motor comprises a DC stepper motor capable of both clockwise and counterclockwise rotation.

15. A latching mechanism for maintaining a container cover in a closed position, said latching mechanism comprising:

spaced apart first and second strikers attached to an inside of the container cover;

movable first and second locking elements that engage respective of said first and second strikers when the container cover is being maintained in the closed position, said first and second locking elements being retracted away from said first and second strikers to release said container cover into an open position;

a rotatable flywheel carrying a drive dog;

a rotating plate rotatable about an axis, said rotating plate having an engaging element that is driven by said drive dog; and first and second levers pivotally connected at their proximal ends to said rotating plate at substantially diametrically opposed locations, distal ends of said first and second levers being connected to said locking elements.

16. A latching mechanism as set forth in claim 15, wherein said axis of said rotating plate corresponds to a rotational axis of said flywheel.

17. A latching mechanism as set forth in claim 16, wherein said flywheel is attached to an output shaft of a DC steeper motor.

18. A latching mechanism as set forth in claim 17, wherein said rotating plate interposes a housing of the motor and the flywheel.

19. A latching mechanism as set forth in claim 15, wherein said distal ends of said first and second levers are pivotally attached to respective first and second stopper plates which are themselves pivotal with respect to a corresponding support structure.

20. A latching mechanism as set forth in claim 15, wherein said first and second stopper plates are connected to said first and second locking elements via respective springs.

21. A latching mechanism as set forth in claim 15, further comprising a mechanical key lock operative to engage one of said first and second levers so as to cause said first and second locking elements to be retracted away from said first and second strikers.

22. A latching mechanism for maintaining a container cover in a closed position, said latching mechanism comprising:

spaced apart first and second strikers attached to an inside of the container cover;

movable first and second locking elements that engage respective of said first and second strikers when the container cover is being maintained in the closed position, said first and second locking elements being retracted away from said first and second strikers to release said container cover into an open position;

a motor having a rotatable flywheel on an output shaft thereof, said flywheel carrying a drive dog on its periphery;

a rotating plate rotatable about an axis, said rotating plate having an engaging element that is driven by said drive dog, said rotating plate interposing a housing of the motor and the flywheel; and first and second levers pivotally connected at their proximal ends to said rotating plate, distal ends of said first and second levers being connected to said locking elements.

* * * * *